US007866569B2

(12) United States Patent
Cadwell

(10) Patent No.: US 7,866,569 B2
(45) Date of Patent: Jan. 11, 2011

(54) RAILROAD CROSS TIE AND METHOD OF MANUFACTURE

(75) Inventor: Charles Edward Cadwell, Fort Wayne, IN (US)

(73) Assignee: Dynamic Composites, LLC, Columbia City, IN (US)

( * ) Notice: Subject to any disclaimer, the term of this patent is extended or adjusted under 35 U.S.C. 154(b) by 67 days.

(21) Appl. No.: 12/319,249

(22) Filed: Jan. 5, 2009

(65) Prior Publication Data

US 2010/0170956 A1 Jul. 8, 2010

(51) Int. Cl.
*E01B 9/14* (2006.01)

(52) U.S. Cl. ..... 238/83; 238/36; 238/84; 238/95; 238/35

(58) Field of Classification Search ..... 238/83, 238/84, 95–100, 104, 29, 35, 36, 38; 29/460, 29/525.01, 527.1, 527.2
See application file for complete search history.

(56) References Cited

U.S. PATENT DOCUMENTS

| | | | | | |
|---|---|---|---|---|---|
| 1,646,248 | A * | 10/1927 | Hojnowski | 238/35 |
| 2,538,443 | A * | 1/1951 | Delvaux | 238/32 |
| 2,556,622 | A * | 6/1951 | Koch | 238/85 |
| 3,576,293 | A * | 4/1971 | Landis et al. | 238/287 |
| 3,863,329 | A * | 2/1975 | Bartlett | 29/428 |
| 4,150,790 | A * | 4/1979 | Potter | 238/83 |
| 4,216,904 | A * | 8/1980 | Vivion | 238/25 |
| 4,221,330 | A * | 9/1980 | Schlaeger | 238/31 |
| 4,416,419 | A * | 11/1983 | Ohno | 238/89 |
| 5,609,295 | A * | 3/1997 | Richards | 238/84 |
| 6,179,215 | B1 * | 1/2001 | Shea | 238/29 |
| 6,336,265 | B1 * | 1/2002 | Niedermair | 29/460 |
| 6,343,748 | B1 * | 2/2002 | Pilesi et al. | 238/310 |
| 2005/0223673 | A1 * | 10/2005 | Cadwell et al. | 52/721.4 |
| 2008/0035747 | A1 * | 2/2008 | Yuan | 238/84 |
| 2008/0173725 | A1 * | 7/2008 | Gibbs | 238/83 |
| 2010/0170956 | A1 * | 7/2010 | Cadwell | 238/85 |

* cited by examiner

*Primary Examiner*—S. Joseph Morano
*Assistant Examiner*—Jason C Smith
(74) *Attorney, Agent, or Firm*—George Pappas

(57) ABSTRACT

A railroad cross tie having an inner core with at least one longitudinally extending metallic reinforcing member and an outer casing. The cross tie includes first and second end caps. The first end cap is disposed proximate a first end of the inner core and the second end cap is disposed proximate a second opposite end. One embodiment of the cross tie includes an expansion gap longitudinally disposed between the first and second end caps. Longitudinal dimensions of the expansion gap varies in response to differential thermal expansion between the inner core and the outer casing. In other embodiments, the end caps are mechanically interlocked with the inner core and the outer casing overlays a portion of the end caps. The disclosed structures securely and reliably attach the end caps to the cross tie. A method of manufacturing cross ties is also disclosed.

27 Claims, 5 Drawing Sheets

RAILROAD CROSS TIE AND METHOD OF MANUFACTURE

BACKGROUND OF THE INVENTION

1. Field of the Invention

The present invention relates to railroad cross ties and, more particularly, composite railroad cross ties and methods of manufacturing composite rail road cross ties.

2. Description of the Related Art

Railway tracks are typically supported on a plurality of individual cross ties. Wooden cross ties are one of the most common types of railroad cross ties. When using a wooden cross tie, the railway tracks are typically secured to the cross tie using tie plates and spikes that are driven into the cross tie. Various other materials, however, are also used to form railroad cross ties. For example, concrete and steel are also used to form cross ties.

Composite railroad cross ties which utilize recycled plastic resins are also known in the art. One example of a composite railroad cross tie is disclosed in U.S. Pat. No. 6,179,215 B1 the disclosure of which is incorporated herein by reference. Composite cross ties often include an inner core that includes a steel reinforcing member encased in concrete and an outer resinous casing surrounding the inner core. The outer casing may be formed out of a material that includes recycled plastic resins. The outer casing provides protection against adverse weather conditions for the inner core. The formation of the outer casing on the inner core, however, may leave the two end surfaces of the inner core exposed. Polymeric end caps can be placed on the two exposed end surfaces of the cross tie in an effort to protect these end surfaces from adverse weather conditions. It has, however, proven difficult to secure polymeric end caps on the exposed end surfaces of composite railroad ties in a reliable manner.

SUMMARY OF THE INVENTION

The present invention provides a railroad cross tie construction and method of manufacture that provides well-secured end caps on the opposing ends of the cross tie.

The invention comprises, in one form thereof, a railroad cross tie having a longitudinal length. The cross tie includes an inner core including at least one longitudinally extending reinforcing member and an outer casing substantially enclosing the inner core along the longitudinal length of the cross tie. First and second end caps are engaged with the outer casing with the first end cap being disposed proximate a first end of the inner core and the second end cap being disposed proximate a second opposite end of the inner core. The cross tie also includes at least one expansion gap that is longitudinally disposed between the first and second end caps. A longitudinal dimension of the expansion gap is varied by differential thermal expansion between the inner core and the outer casing.

The invention comprises, in another form thereof, a railroad cross tie having a longitudinal length and which includes an inner core including at least one longitudinally extending reinforcing member, an outer casing substantially enclosing the inner core along the longitudinal length of the cross tie and first and second end caps. The first end cap is disposed proximate a first end of the inner core and the second end cap is disposed proximate a second end of the inner core with each of the first and second end caps being welded to the outer casing.

The invention comprises, in yet another form thereof, a railroad cross tie having a longitudinal length and which includes an inner core including at least one longitudinally extending reinforcing member, an outer casing substantially enclosing the inner core along the longitudinal length of the cross tie, and first and second end caps. The first end cap is disposed proximate a first end of the inner core and the second end cap is disposed proximate a second end of the inner core. At least a portion of each of the first and second end caps is overlain by the outer casing such that dislocation of the outer casing is required to detach the first and second end caps from the cross tie.

The invention comprises, in still another form thereof, a railroad cross tie having a longitudinal length and which includes an inner core including at least one longitudinally extending reinforcing member, an outer casing substantially enclosing the inner core along the longitudinal length of the cross tie and first and second end caps. The first end cap is disposed proximate a first end of the inner core and the second end cap is disposed proximate a second end of the inner core. First and second retention members are respectively disposed at the first and second ends of the inner core with the first end cap being secured to the first retention member and the second end cap being secured to the second retention member.

The invention comprises, in still another form thereof, a method of manufacturing railroad cross ties wherein each of the cross ties has a longitudinal length. The method includes providing a plurality of longitudinally extending inner cores for manufacturing a corresponding number of cross ties, securing two adjacent inner cores together in an end-to-end configuration by attaching a connecting member to each of the adjacent inner cores, and forming an outer casing on the exterior of the adjacent inner cores. The adjacent inner cores are then separated to form first and second cross ties by separating the connecting member into a first part and a second part wherein the first part of the separated connecting member forms a portion of the first cross tie and the second part of the separated connecting member forms a portion of the second cross tie.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
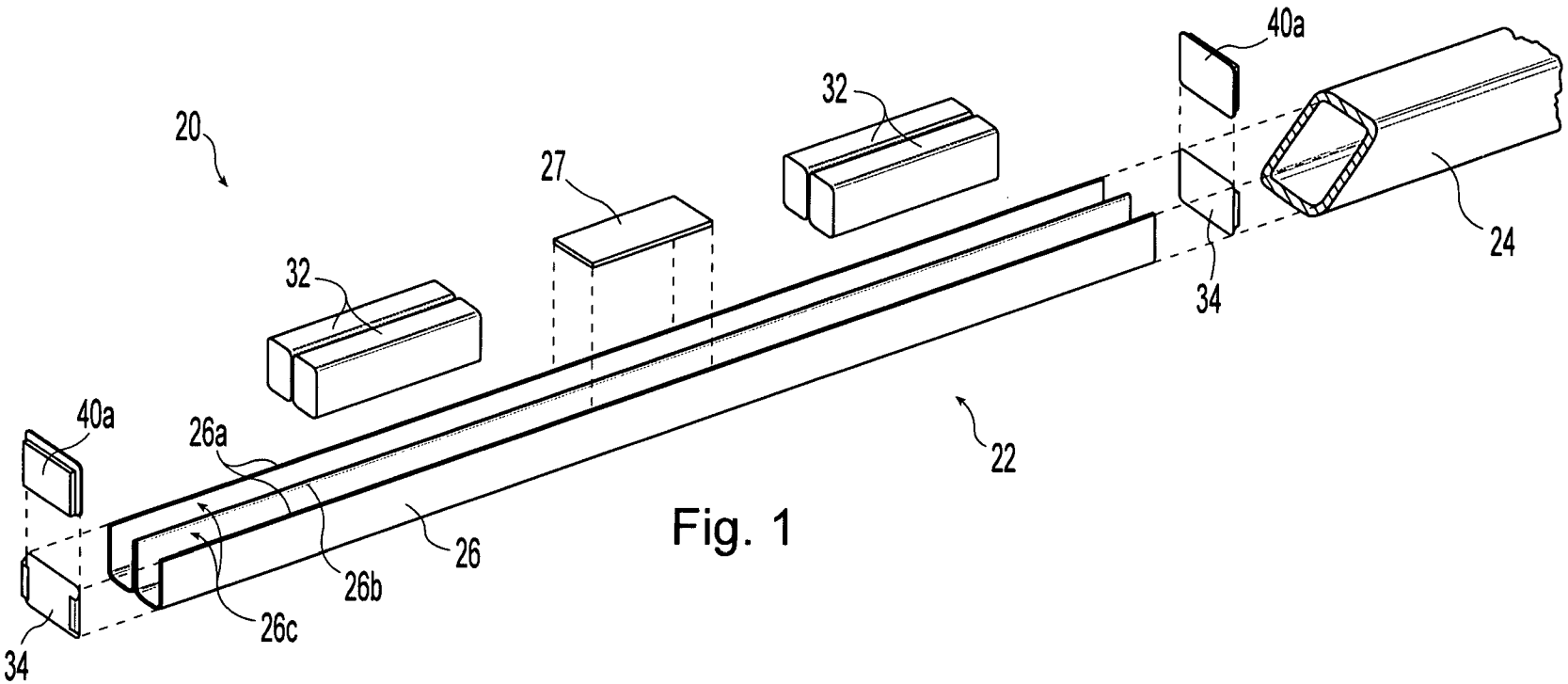
FIG. 1 is an exploded perspective view of a first cross tie.

Corresponding reference characters indicate corresponding parts throughout the several views. Although the exemplification set out herein illustrates several embodiments of the invention, in various forms, the embodiments disclosed below are not intended to be exhaustive or to be construed as limiting the scope of the invention to the precise forms disclosed.

DETAILED DESCRIPTION OF THE INVENTION

Figure 2:
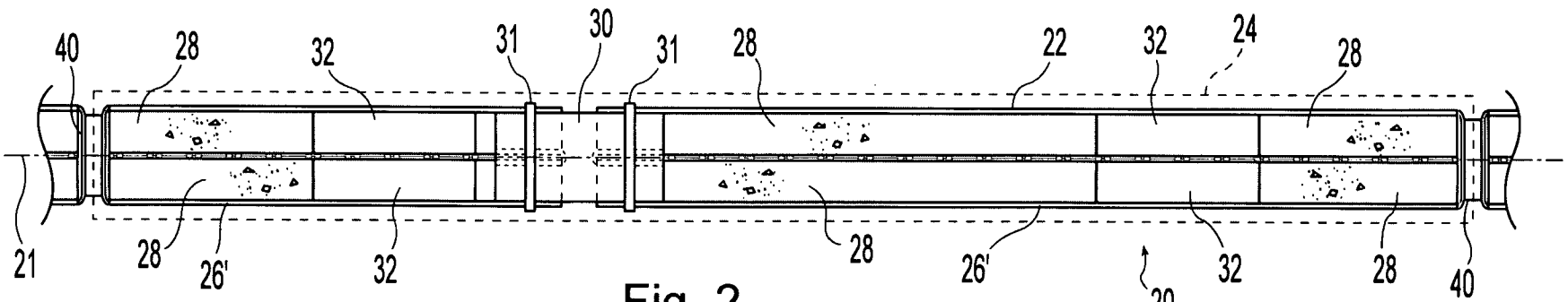
FIG. 2 is a top view of a second cross tie.

Two similar cross tie designs in accordance with the present invention are illustrated in FIGS. 1 and 2. The individual parts forming these two cross ties will be discussed below. Following the discussion of the individual cross tie parts, a manufacturing method that can be used to make the cross ties will be described.

FIG. 1 provides an exploded view of a railroad cross tie 20. Cross tie 20 includes an elongate inner core 22 and an outer casing 24. Various different inner core designs may be used with the present invention, and the inner core 22 illustrated in FIG. 1 includes a single elongate metal reinforcing member 26 having a generally W-shaped profile and a concrete filler 28. A stiffening plate 27 is welded to the upper ends of reinforcing member 26 at the midsection of reinforcing member 26. While both reinforcing member 26 and stiffening plate 27 are steel in the illustrated embodiment, other metallic and non-metallic materials may be used to form reinforcing member 26 and/or stiffening plate 27 in alternative embodiments.

As illustrated in FIG. 2, reinforcing member 26 may be formed of two separate elongate reinforcing members 26' with an insulative reinforcing member 30 being used to structurally join and electrically separate the two reinforcing members 26' instead of employing a single reinforcing member 26 that extends for the substantial entirety of the length of inner core 22. In both embodiments of the reinforcing members, reinforcing members 26, 26' have a generally W-shaped profile with outer walls 26*a*, a center upright 26*b* and two upwardly opening elongate troughs 26*c*. Advantageously, the reinforcing members 26, 26' may be formed by bending sheet steel to form the W-shaped profile. Reinforcing members having alternative profiles may also be used such as a hollow H-shaped profile as is well-known in the art.

Inserts 32 are seated within the profile of the reinforcing members 26, 26' at locations where spikes are commonly used to attach tie plates to cross ties. The illustrated inserts 32 are 10% polyethylene and 90% rubber (by volume), however, various other materials may also be used to form inserts 32. Both the polyethylene and the rubber used to form inserts 32 may be recycled materials. The polyethylene may be a high density polyethylene obtained from recycled household containers while the rubber may be crumb rubber obtained from used automotive tires. The use of such inserts 32 with cross ties 20 allows conventional spikes and tie plates (not shown) to be used to secure railroad rails to the cross ties 20 in the same manner that such spikes and tie plates are used to secure railroad rails to wooden cross ties.

Figure 7:
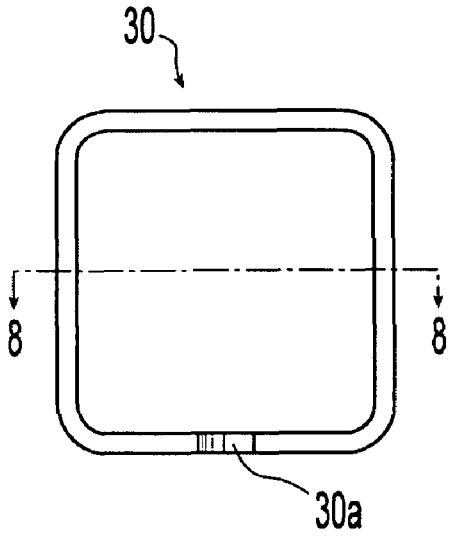
FIG. 7 is an end view of an insulative reinforcing member.
Figure 8:
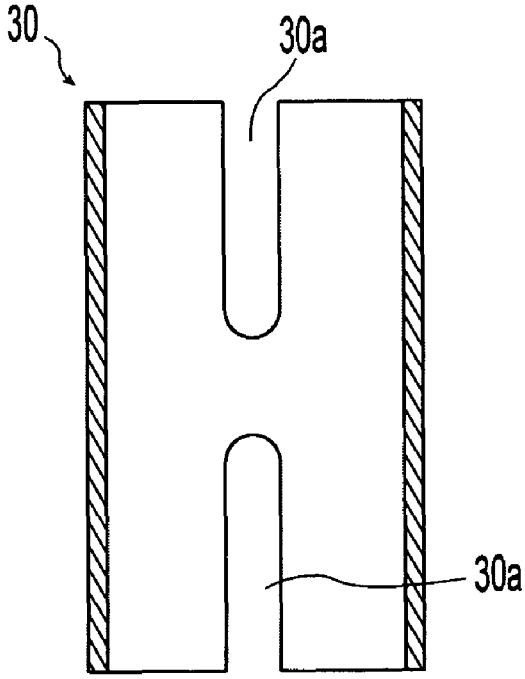
FIG. 8 is a top view of the insulative reinforcing member of FIG. 7.

Insulative reinforcing member 30 is shown in greater detail in FIGS. 7 and 8 and has a generally rectangular tubular form and is a fiberglass and polyester pultrusion. Reinforcing insulator 30 is slidingly received and seated within the outer walls 26*a* of reinforcing members 26'. Reinforcing member 30 has U-shaped cutouts 30*a* for receiving the central uprights 26*b* of reinforcing members 26'. Steel straps 31 are tightly secured about the outer perimeter of each of the two reinforcing members 26' being joined together by insulator 30 to securely engage each of the two reinforcing members 26' with reinforcing insulator 30. The reinforcing insulator 30 advantageously separates the two metallic reinforcing members 26' by about 0.5 to 2 inches (1.3 to 5.1 cm) to thereby electrically separate the two metallic reinforcing members 26'.

Insulator 30 is positioned between the two longitudinally spaced sets of inserts 32 so that, if the spikes used to secure the rails to cross ties 20 contact metallic reinforcing members 26', insulator 30 will prevent the communication of an electrical current between the two rails secured to the cross tie 20. Railroad rails are often used as electrical conductors for communication signals that facilitate the operation of trains on the rails. The use of insulators 30 to prevent the communication of electrical currents between the two separate rails attached to cross tie 20 helps to preserve this functional aspect of the rails attached to the cross tie 20.

In an alternate embodiment, insulative reinforcing member 30 comprises two (2) separate tubular pultrusions, each being slidingly received and seated within one of the side-by-side elongate troughs 26*c* of the reinforcing members 26'. Similarly, steel straps 31 would be tightly secured about the outer perimeter of each of the two reinforcing members 26' being joined together by the two separate tubular pultrusions to securely engage each of the two reinforcing members 26' with the two tubular pultrusions. It is further noted that the two separate pultrusions can be replaced by solid elongate beam members similar in shape to the inserts 32 and used in place of reinforcing member 30. In both alternate embodiments, however, the two separate tubular pultrusions and the solid elongate beam members would be made of an electrically insulative material such as fiberglass and polyester so that, in addition to joining the reinforcing members 26' to one another, the reinforcing members 26' are also maintained apart and are electrically insulated from one another.

Each inner core 22 also includes a pair of retention members 34 disposed at the opposite ends of the inner core 22. The illustrated retention members 34 are formed out of sheet steel. A retention member 34 is welded to each end of reinforcing member 26 with the outward facing planar surfaces 36 of members 34 being positioned perpendicular to the longitudinal axis 21 defined by cross tie 20 and which is also the longitudinal axis of the inner core 22. The use of a metallic plate to form retention member 34 allows interlocking C-shaped flange members 38 to be easily formed on retention member 34 by bending outwardly projecting tabs on the metallic plate to form inwardly opening C-shaped flanges. As discussed below, C-shaped flanges 38 secure connecting members 40 to inner core 22.

After assembling reinforcing members 26' with insulator 30 and attaching retention members 34 to the opposing ends of the inner core assembly, stiffening plate 27 is welded to reinforce member 26 and inserts 32 are positioned at the proper locations within the troughs 26*c* formed by the W-shaped profile of reinforcing members 26'. Concrete is then used to fill the remaining volume of the inner core 22. When using a single reinforcing member 26, stiffening plate 27 is welded to reinforcing member 26, retention members 34 are attached to the opposite ends of reinforcing member 26 and inserts 32 are positioned in troughs 26*c* before filling the remainder of troughs 26*c* with concrete.

As mentioned above, the W-shaped profile of the illustrated reinforcing members 26, 26' defines two upwardly opening troughs 26*c* (FIG. 1) on opposite sides of the central upright portion 26*b*, between central upright 26*b* and outer walls 26*a*. Retention members 34 have a width and height that corresponds to that of the two troughs 26*c* defined by reinforcing members 26, 26' and thereby form dams at the ends of reinforcing members 26, 26'. This configuration allows wet concrete to be poured into the two troughs 26*c* without having the concrete run out the ends of the reinforcing members 26, 26'.

Other embodiments of the invention, however, may utilize concrete formwork to encase reinforcing members.

The concrete is allowed to reach its initial set before outer casing 24 is applied to inner core 22 as discussed in greater detail below. Delaying the application of the outer casing 24 by at least about 24 hours provides the concrete with sufficient time to reach its initial set in the absence of unusual conditions or unique concrete mixtures. The 24 hour waiting period also provides time for evaporation of excessive surface water that may have accumulated on the upper surface of the concrete during the initial set. In the illustrated embodiment, concrete material 28 is a conventional mixture that includes portland cement, aggregate and fines.

When applying the outer casing 24 to inner cores 22, the inner cores 22 are passed through an extruder apparatus 60 (FIG. 9) that extrudes a molten material onto the inner cores 22 to form outer casing 24. The inner cores 22 are arranged end-to-end as they pass through extruder apparatus 60. Connecting members 40 are used to secure adjacent inner cores 22 together such that adjacent inner cores 22 are arranged end-to-end with their respective longitudinal axes 21 being substantially co-linear. The use of connecting members 40 to connect two adjacent inner cores 22 together is best understood with reference to FIGS. 3 and 4.

Figure 3:
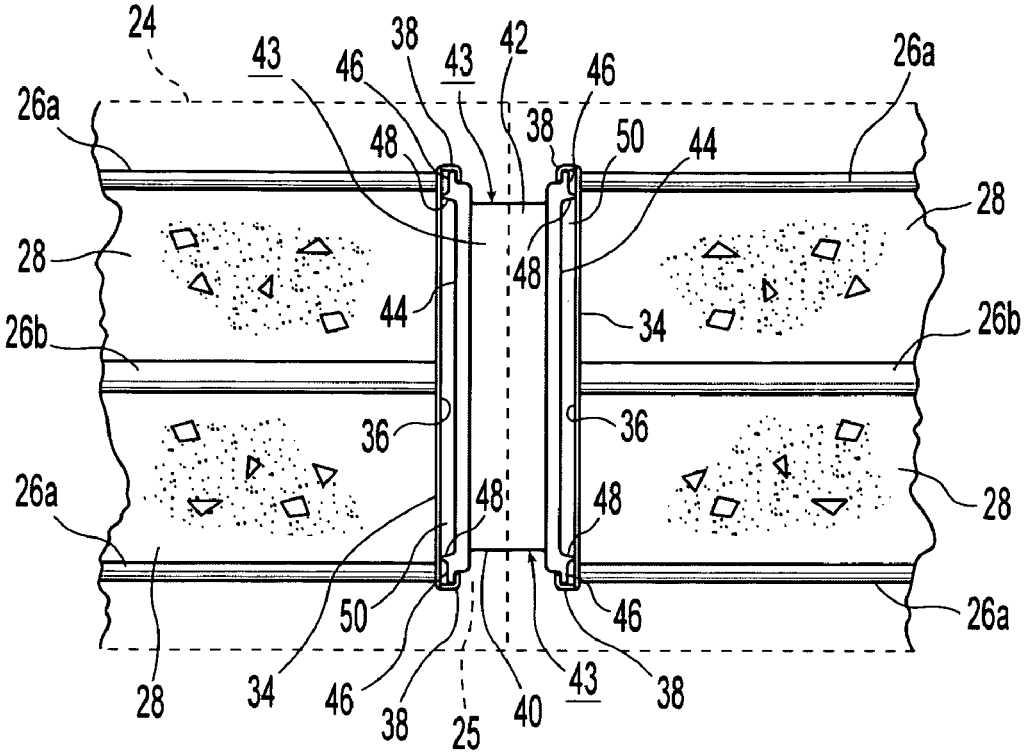
FIG. 3 is a top view of adjacent ends of two cross ties that are connected together.
Figure 4:
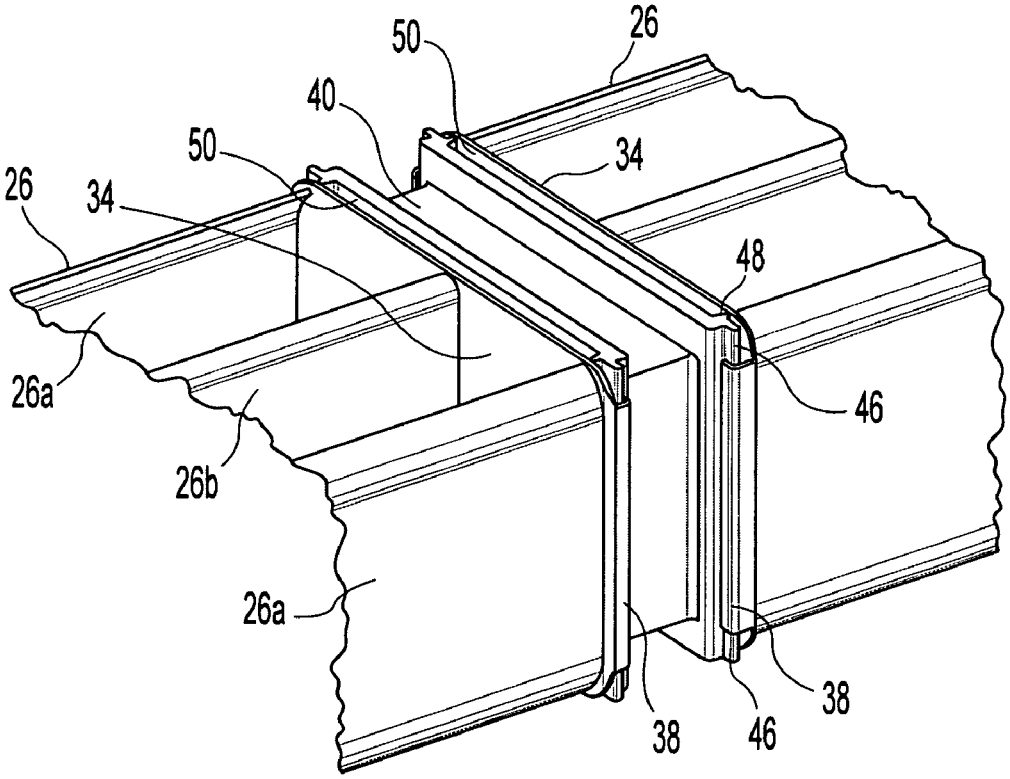
FIG. 4 is a perspective view of adjacent ends of two cross ties that are connected together.
Figure 5:
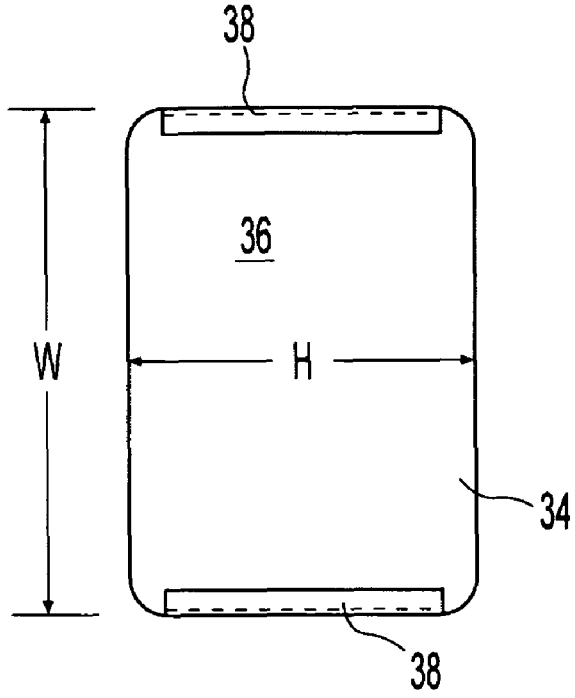
FIG. 5 is an end view of a retention member.
Figure 6:
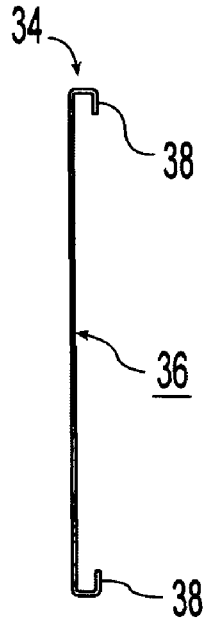
FIG. 6 is a side view of the retention member of FIG. 5.

Connecting members 40 are preferably made of 100% polyethylene by injection molding. As can be seen in FIGS. 3 and 4, connecting members 40 include a longitudinally extending block portion 42 with opposing longitudinal ends that have a substantially planar central portion 44 facing the inner cores 22. The planar portions 44 are oriented substantially perpendicular to longitudinal axis 21. Connecting members 40 also include interlocking flange members 46 which take the form of a pair of outwardly extending flanges disposed on opposite edges of the block portion 42. Flange members 46 are slidingly received within and are engaged with C-shaped flanges 38 on retention members 34 to thereby secure connecting member 40 to retention members 34 of adjacent inner cores 22.

Connecting members 40 also include spacing members 48 which project longitudinally outwardly, away from the block portion 42. Spacing members 48 bias the substantially planar portion 44 of connecting member 40 away from planar surfaces 36 on retention members 34 to thereby form expansion gaps 50 between connecting members 40 and retention members 34. By biasing connecting member 40 away from planar surfaces 36 on retention members 34, spacing members 48 also keep flange members 46 tightly engaged within C-shaped flanges 38 on retention members 34.

After outer casing 24 has been applied to the inner cores 22 and the connecting members 40, the connecting members 40 and the outer casing 24 coating the connecting members 40 are severed at the longitudinal midpoint of the connecting members 40 at the block portion 42. The resulting two parts of the connecting member 40 form two separate end caps 40*a* located on separate cross ties 20. The exploded view of FIG. 1 illustrates a single cross tie 20 and two end caps 40*a* after the connecting members 40 located on the opposing ends of the cross tie 20 have been severed. In contrast, FIG. 2 is a top view that illustrates an inner core 22 (centrally located in FIG. 2) wherein each of the two opposing ends of the inner core 22 is still connected with an adjacent inner core 22 by a unitary not yet severed connecting member 40. The dashed lines 24 in FIG. 2 illustrate the boundary of the outer casing 24 that will be applied to the central inner core 22 and where the outer casing 24 and connecting members 40 will be severed when separating the central inner core 22 from the adjacent inner cores 22 to form separate cross ties 20.

The manufacture of cross ties 20 will now be discussed. As mentioned above, the inner core 22 of the embodiment of FIG. 1 is assembled by attaching retention members 34 to opposing ends of reinforcing member 26, attaching stiffening plate 27 to the upper edges of outer walls 26*a* and center upright 26*b* at the longitudinal center of reinforcing member 26 and positioning inserts 32 in troughs 26*c*. Concrete material is then used to fill the remainder of troughs 26*c*. The assembly of inner core 22 of the embodiment shown in FIG. 2 is similar to that of the inner core 22 of FIG. 1, but instead of attaching a stiffening plate 27 to a single reinforcing member 26, the embodiment of FIG. 2 requires the attachment of two elongate reinforcing members 26' with insulative reinforcing member 30 and straps 31.

For both of the illustrated embodiments, the concrete material 28 is advantageously allowed to set for at least about 24 hours before applying the outer casing 24. Prior to applying the outer casing 24, a plurality of the inner cores 22 are connected together in an end-to-end fashion with connecting members 40, with the longitudinal axes of the plurality of inner cores 22 being substantially co-linear as exemplified by FIG. 2.

Figure 9:
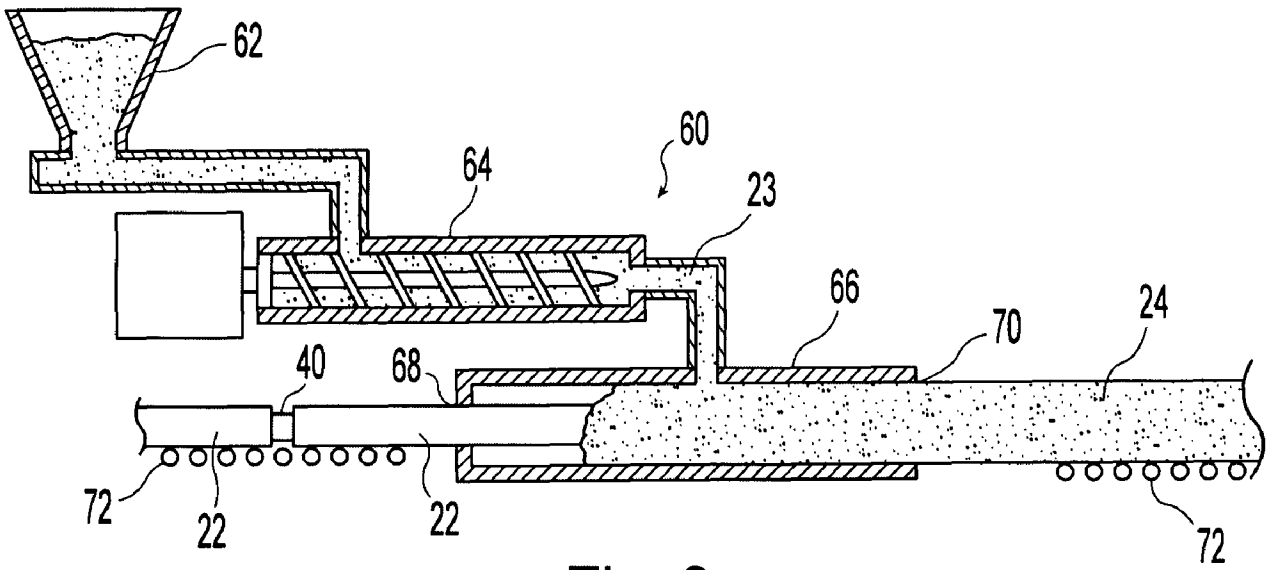
FIG. 9 is a schematic view of a molding apparatus used in the manufacture of the cross ties.

The inner cores 22 may be connected with connecting members 40 either after the filling of troughs 26*c* with concrete 28, or, as depicted in FIG. 4, the connecting members 40 can be used to secure together the reinforcing members 26, 26' of a plurality of inner cores 22 prior to the filling of troughs 26*c* with concrete 28 or other suitable filler material. After connecting the inner cores 22 with connecting members 40 and allowing concrete 28 to set, outer casing 24 is applied to the inner cores 22 as schematically depicted in FIG. 9.

The extruder apparatus 60 includes one or more feedstock sources 62 for feeding an extruder screw 64 with the feed stock material 23 that will form outer casing 24. In the illustrated embodiment, outer casing 24 is formed out of a mixture containing 50% polyethylene and 50% rubber (by volume) but other suitable compositions may be used in alternative embodiments.

The extruder screw 64 extrudes molten material 23 into mold cavity 66 where it is applied to inner cores 22 which are being transported through mold cavity 66. Mold cavity 66 has an inlet port 68 and an outlet port 70 through which the inner cores 22 respectively enter and depart mold cavity 66. Conveyor systems 72 on either side of mold cavity 66 support the linked together inner cores 22 and provide the driving force for moving inner cores 22 through mold cavity 66. Connecting members 40 link the inner cores 22 together and impart both pushing and pulling forces between the linked inner cores 22 as the inner cores 22 are transported along conveyor systems 72 and through molding cavity 66. Connecting members 40 are, thus, subjected to both compressive and tension forces.

While the feed material 23 is molten when introduced into mold cavity 66, it is relatively viscous and is not in a free flowing liquid state. As a result, the feed material 23 does not fill expansion gap 50 and, to the extent that it enters expansion gap 50 at all, it enters only a relatively insignificant portion of the outer edges of gap 50. Due to the viscous nature of feed material 23, feed material 23 does not completely fill mold cavity 66 and the area of mold cavity 66 near inlet port 68 will not be filled with material 23 as schematically depicted in FIG. 9. The area adjacent outlet port 70 is filled because, as inner cores 22 travel through mold cavity 66, the inner cores 22 transport the material 23 that has been applied thereto. When introduced into mold cavity 66, feed material 23 is sufficiently molten and at a sufficient pressure so that it fully surrounds inner cores 22 and the inner cores 22 are fully enclosed/encapsulated within outer casing 24 along the longitudinal length of cross ties 20. In this regard, it noted that the laterally outward facing surfaces 43 of connecting members 40 are also engaged with and fully enclosed by feed material 23/outer casing 24. That is, the feed material 23/outer casing 24 fills the volumetric area over outward surfaces 43 and around connecting members 40. The mold cavity 66 and outlet port 70 shape the feed material 23/outer casing 24 to form a substantially rectangular outer profile for cross ties 20 that is similar to the profile of conventional wooden cross ties.

Figure 10:
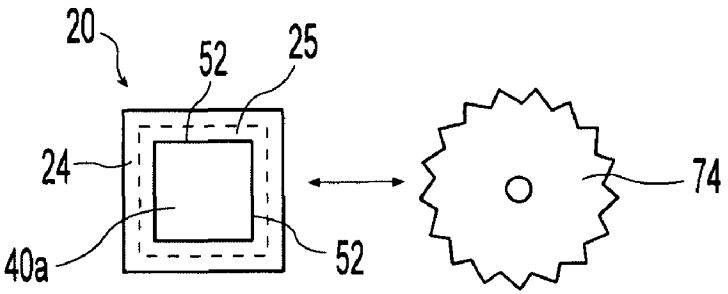
FIG. 10 is a schematic view of a cutting operation separating two adjacent cross ties.

After exiting mold cavity 66, the inner cores 22 which now have outer casing 24 applied thereto may be passed through a curing oven and/or a cooling station (not shown) prior to separating the coated inner cores to form individual cross ties 20. After outer casing 24 has been applied to the inner cores 22 and the connecting members 40 between inner cores 22, a cutting apparatus 74 is used to sever the outer casing 24 and connecting members 40 at the longitudinal midpoint of connecting members 40 as schematically depicted in FIG. 10. Various methods may be used to determine the proper midpoint location of the connecting members 40 at which the cut should be made to sever the connected inner cores 22 into separate cross ties 20. For example, when using steel reinforcing members 26, 26' and steel retention members 34, electromagnetic sensors can be used to detect the electromagnetic gap between adjacent inner cores 22 resulting from the polyethylene connecting members 40. Simple measurements of length may also be used in combination with electromagnetic sensors or in isolation to determine the proper location at which the cut should be made. In this regard, it is noted that the first inner core 22 and the last inner core 22 of each production run will have one end at which the connecting member 40 is not connected to an adjacent inner core 22. These connecting blocks 40, i.e., the very first connecting member 40 to pass through mold cavity 66 and the very last connecting member 40 to pass through mold cavity 66, will also have to be severed at the longitudinal midpoint of the connecting member 40 to ensure that the cross ties 20 all have a common longitudinal length.

As can be seen in FIG. 10, once the cutting operation has separated the individual inner cores 22 to form separate cross ties 20, the ends of the cross ties 20 will have an outer surface that is formed by outer casing 24 and a central area formed by end caps 40*a*. The end caps 40*a* each being one half of a connecting member 40 and forming an integral part of the cross tie 20. The outer casing 24 forms a seam 52 proximate the exterior surface of cross tie 20 where outer casing 24 engages laterally outward facing surface 43 of longitudinally projecting block portion 42 of end caps 40*a*.

The cross tie 20 formed after the severing operation depicted in FIG. 10 will have a generally weather resistant exterior surface. Outer casing 24, while not providing a perfect moisture barrier, will provide substantial weather resistance to cross tie 20. End cap 40*a*, which is formed out of polyethylene material in the illustrated embodiment, will also provide substantial weather resistance. A seam 52 is located between end cap 40*a* and outer casing 24 along surface 43 where end caps 40*a* abut the outer casing 24 proximate the exterior surface of cross tie 20. Seam 52, while likely to provide some resistance to the passage of moisture, does provide a potential entry path for moisture into the interior of cross tie 20. To limit the possibility of seam 52 providing an entry path for moisture, seam 52 may be sealed. For example, an adhesive or sealant could be applied to the seam 52. In the illustrated embodiment, seam 52 is heat sealed without having to apply a sealant or adhesive to seam 52.

Figure 11:
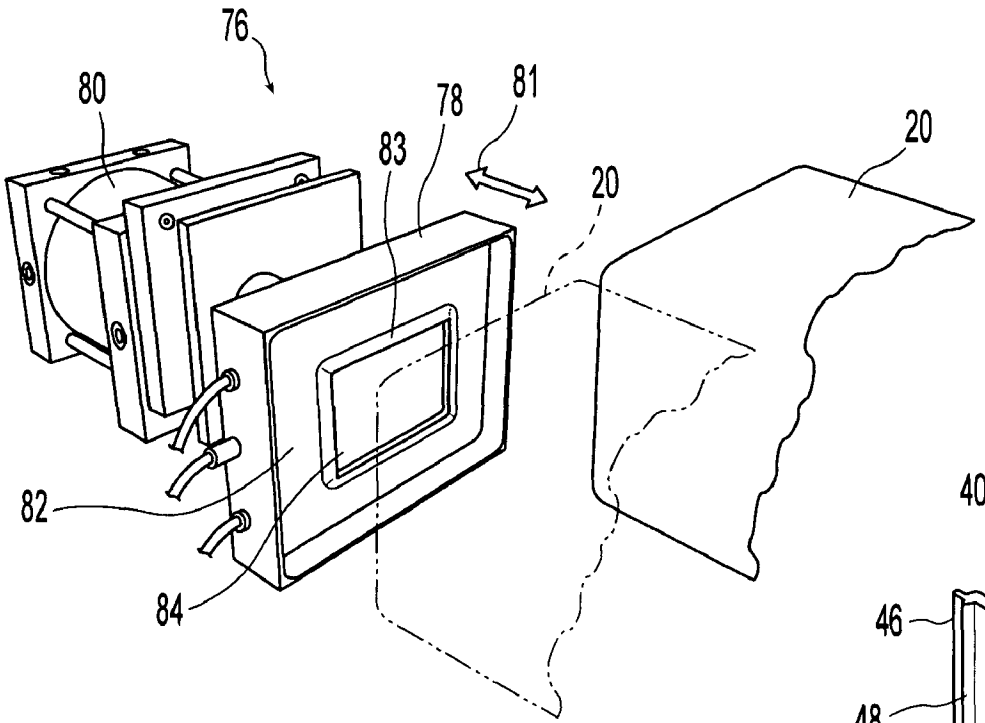
FIG. 11 is a perspective view of a thermal die apparatus.

A thermal die apparatus 76 that can be used to heat seal seam 52 by welding is illustrated in FIG. 11. It is noted that, as used herein, the term "welding" refers to a process by which a portion of at least one of two parts being joined together is at least partially melted and then allowed to re-solidify such that, when the melted material re-solidifies, a bond will be formed between the two parts regardless of the particular type of material.

Apparatus 76 includes a thermal die 78 that is heated and pressed against an end of a cross tie 20 to heat seal seam 52 by partially melting one or both of end cap 40*a* and outer casing 24. Thermal die 78 includes an outer portion 82 that is positioned opposite outer casing 24 and an inner area 84 that is positioned opposite end cap 40*a*. A projecting rib 83 is preferably provided and engages the area immediately adjacent seam 52 on both sides of seam 52 for transferring thermal energy deep into this area thereby further assuring the polyethylene end cap 40*a* and the polyethylene and rubber casing 24 are melted and welded at the seam 52. A drive unit 80 such as a pneumatic ram moves die 78, and thus rib 83, into and out engagement with the end surface of cross ties 20 as indicated by arrow 81. In FIG. 11, cross tie 20 shown in solid lines is resting on a conveyor system (not shown) and has not yet moved into position to be engaged with die 78. The cross tie 20 shown in dashed lines has been moved on the conveyor and is in position to be engaged with die 78.

When die 78 is pressed against the end of cross tie 20, it will transfer thermal energy to the outer casing 24 and end cap 40*a* and thereby at least partially re-melt one or both of these portions of cross tie 20 at least along the location of seam 52. When the re-melted portions re-solidify after cross tie 20 no longer is engagement with die 78, the re-solidified portions will form a weld 53 (FIG. 12) that seals the full length of seam 52 proximate the exterior surface of cross tie 20. This weld also helps to secure end caps 40*a* with outer casing 24 and thereby helps to retain end caps 40*a* in place on cross ties 20. Although only one thermal die apparatus 76 is shown, both ends of cross tie 20 are subjected to this welding/heat sealing process either by simultaneously providing an apparatus 76 on both ends of the cross tie or moving the cross tie on a conveyor to subject the ends thereof to the same apparatus 76.

Figure 12:
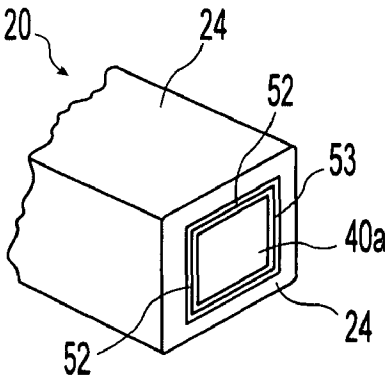
FIG. 12 is a perspective view of a cross tie end after being heat sealed.

FIG. 12 illustrates one end of a cross tie 20 after it has been welded using die 78. An area generally corresponding to the shape of rib 83 is formed along the length of seam 52 where rib 83 has engaged cross tie 20 to form weld 53 and thereby seal seam 52. Excess melted material formed when creating weld 53 may form small projections on either side of weld 53. Die 78 may also be provided with alphanumeric or graphical elements that will imprint such alphanumeric or graphical elements on end caps 40*a* and/or outer casing 24. For example, the trademark logo of the manufacturer could be imprinted or a graphical element could be imprinted indicating which side of the cross tie is the "top" side to thereby facilitate the proper installation of cross tie 20 so that inserts 32 are properly positioned to receive the rails attaching spikes.

A significant advantage of the illustrated cross tie 20 is that end caps 40*a* remain reliably attached to cross tie 20. When manufacturing cross ties 20, the feed material 23 will be at an elevated temperature when it is applied to inner cores 22 while the inner cores 22 will be at or near the ambient environmental temperature. For example, the feed material is at a temperature of approximately 375° F. (191° C.) in the illustrated embodiment. As outer casing 24 cools, the longitudinal length of outer casing 24 will shrink relative to the longitudinal length of inner core 22. This differential shrinkage causes the opposing ends of inner core 22 to push longitudinally outwardly against the end caps.

Moreover, in light of the differences in the coefficient of thermal expansion between the outer casing 24 and inner core 22, the outer casing 24 and inner core 22 will elongate and contract at different rates when the cross tie 20 is placed in use outdoors and is subjected to the elements and temperature variations. These differences in thermal growth and contraction will also cause the opposing ends of inner core 22 to push longitudinally against the end caps.

The illustrated cross ties 20 have several separate features which can be used either separately or in combination to enhance the securement of end caps 40*a* to cross ties 20 and for preventing the end caps 40*a* from becoming dislodged as a result of differential thermal expansion between the core 22 and casing 24. These features include expansion gaps 50; the mechanical interlocking of end caps 40*a* with inner core 22; the welding of end caps 40*a* to outer casing 24; and, the overlaying of a portion of end caps 40*a* by outer casing 24.

Figure 13:
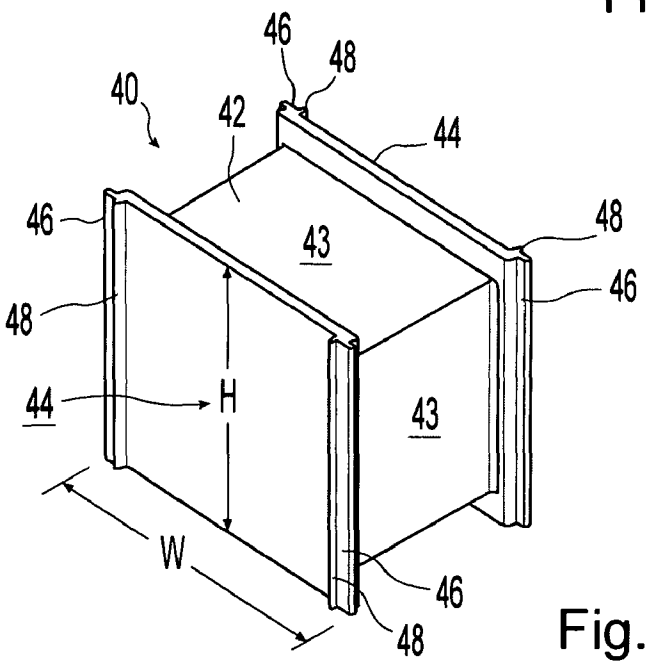
FIG. 13 is a perspective view of a connecting member.

As discussed above, end caps 40*a* are disposed proximate opposing ends of inner core 22 with the entire longitudinal length of inner core 22 disposed between the two end caps 40*a*. Expansion gaps 50 are located between end caps 40*a* and the opposing ends of inner core 22. In the illustrated embodiment, expansion gaps 50 are defined by the planar surfaces 36 of retention members 34 which face and are spaced apart from the planar central portions 44 of end caps 40*a*. The longitudinal dimension of expansion gaps 50 will vary in response to the differential thermal expansion of outer casing 24 and inner core 22 to thereby reduce some of the forces applied to end caps 40*a* that are induced by the differential thermal expansion and contraction of outer casing 24 and inner core 22. In the illustrated embodiment, the longitudinal distance between surface 36 and surface 44, i.e., the longitudinal dimension of expansion gap 50, is preferably approximately 0.125 inches (0.317 cm) when connecting member 40 is secured to retention member 34 of inner cores 22 and prior to the application of outer casing 24. This longitudinal distance can, however, be greater as needed to accommodate the differential thermal expansion. It is also noted that, in the illustrated embodiment, retention member 34 and inner core 22 have a common width (W) and height (H) that is substantially equivalent to the width (W) and height (H) of expansion gap 50 (as depicted against connecting member 40 in FIG. 13) to facilitate the force-relieving function of expansion gaps 50.

As also discussed above, the illustrated embodiments of cross ties 20 include end caps 40*a* that are mechanically interlocked with inner core 22 by the engagement of flanges 46 with C-shaped flanges 38 of retention members 34. This mechanical fixation of end caps 40*a* to inner cores 22 helps to ensure that end caps 40*a* remain firmly attached to inner core 22 as end caps 40*a* are subjected to stresses caused by variations in the thermal expansion or contraction of outer casing 24 and inner core 22 or other forces which might have an impact on the attachment of end caps 40*a*.

The thermal welding of end caps 40*a* to outer casing 24 along seam 52 also helps to ensure that end caps 40*a* remain secured to cross ties 20. When the thermal weld joining end caps 40*a* to outer casing 24 extends along the entire length of seam 52, the weld also acts as a seal inhibiting the inward migration of moisture through seam 52.

The physical configuration of end caps 40*a* and outer casing 24 also helps to secure and retain end caps 40*a* on cross ties 20. As discussed above, end caps 40*a* include outwardly extending flanges 46 that are received by C-shaped flanges 38. Once outer casing 24 has been formed on inner cores 22 and connecting members 40 and the individual cross ties subsequently separated, the outer casing 24 will include a portion 25 that overlays flanges 46 and block 42 and thereby prevents end caps 40*a* from being detached from cross tie 20. The general extent of overlaying portion 25 is indicated between dashed lines and seam 52 in FIG. 10. To detach end caps 40*a*, overlaying portion 25 of outer casing would have to be dislocated, e.g., cut off, to allow end caps 40*a* to be detached from cross tie 20. This physical embedding of end caps 40*a* within outer casing 24 provides yet another feature that works to firmly retain end caps 40*a* on cross tie 20.

While this invention has been described as having an exemplary design, the present invention may be further modified within the spirit and scope of this disclosure. This application is therefore intended to cover any variations, uses, or adaptations of the invention using its general principles.

What is claimed is:

1. A method of manufacturing railroad cross ties, each of the cross ties having a longitudinal length, said method comprising:

providing a plurality of longitudinally extending inner cores for manufacturing a corresponding number of cross ties;

securing two adjacent inner cores together in an end-to-end configuration by attaching a connecting member to each of the adjacent inner cores and wherein the connecting member is capable of imparting both compressive and tensile longitudinal forces between the two adjacent inner cores when the two adjacent inner cores are secured together by the connecting member;

forming an outer casing on the exterior of the adjacent inner cores;

separating the adjacent inner cores to form first and second cross ties by separating the connecting member into a first part and a second part wherein the first part of the separated connecting member forms a portion of the first cross tie and the second part of the separated connecting member forms a portion of the second cross tie.

2. The method of claim 1 wherein the step of securing two adjacent inner cores together by attaching a connecting member to each of the adjacent inner cores includes forming an expansion gap between the connecting member and each of the adjacent inner cores; wherein the step of forming an outer casing on the exterior of the adjacent inner cores includes forming the outer casing on the inner core with the outer casing being at a higher temperature than the inner core; and wherein the method further includes allowing the outer casing material and inner core to reach a common temperature after forming the outer casing.

3. The method of claim 1 further comprising the step of applying thermal energy to a seam formed between the connecting member and the outer casing on each of the first and second cross ties to thereby form a weld securing the connecting member with the outer casing.

4. The method of claim 1 wherein said step of forming an outer casing further comprises forming an outer casing on the exterior of the connecting member; and said step of separating the adjacent inner cores further comprises severing the outer casing disposed about the connecting members.

5. The method of claim 4 wherein the outer casing formed on the exterior of the connecting member overlays at least a portion of the first part and the second part of each of the connecting members and, subsequent to the step of severing the outer casing, dislocation of the outer casing is required to detach said first and second parts of each of the connecting members.

6. The method of claim 1 wherein the connecting member is provided with at least one first interlocking member on the first part of the connecting member and at least one first interlocking member on the second part of the connecting member;

wherein the step of providing a plurality of inner cores includes providing each of the longitudinally extending inner cores with at least one metallic reinforcing member and a metallic retention member disposed at an end of the inner cores wherein each of the retention members includes at least one second interlocking member; and wherein the step of securing the two adjacent inner cores together includes engaging the first interlocking member on the first par of the connecting member with the second interlocking member on the retention member on one of the inner cores and engaging the first interlocking member on the second part of the connecting member with the second interlocking member on the retention member on the other one of the inner cores.

7. The method of claim 6 wherein the step of securing two adjacent inner cores together by attaching a connecting member to each of the adjacent inner cores includes forming an expansion gap between the connecting member and each of the retention members; wherein the step of forming an outer casing on the exterior of the adjacent inner cores includes forming the outer casing on the inner core with the outer casing being at a higher temperature than the inner core; and wherein the method further includes allowing the outer casing material and inner core to reach a common temperature after forming the outer casing.

8. The method of claim 6 wherein the at least one reinforcing member has a substantially W-shaped cross section.

9. The method of claim 1 wherein the material used to form the outer casing is a 50/50 mixture by volume of polyethylene and rubber.

10. The method of claim 1 wherein said step of securing two adjacent inner cores comprises securing the two adjacent inner cores with a unitary connecting member and said step of separating the adjacent inner cores comprises cutting the connecting member.

11. The method of claim 10 wherein the connecting member comprises a polyethylene material.

12. The method of claim 11 wherein the material used to form the outer casing is a 50/50 mixture by volume of polyethylene and rubber and the method further includes:

applying thermal energy to a seam formed between the connecting member and the outer casing on each of the first and second cross ties to thereby form a weld securing the connecting member with the outer casing.

13. A cross tie manufactured in accordance with the method of claim 12.

14. A cross tie manufactured in accordance with the method of claim 1.

15. The cross tie of claim 14 wherein a first expansion gap is defined between the first part of the connecting block and the inner core of the first cross tie and a second expansion gap is defined between the second part of the connecting block and the inner core of the second cross tie.

16. A method of manufacturing railroad cross ties, each of the cross ties having a longitudinal length, said method comprising:

providing a plurality of longitudinally extending inner cores for manufacturing a corresponding number of cross ties;

securing two adjacent inner cores together in an end-to-end configuration by attaching a connecting member to each of the adjacent inner cores;

forming an outer casing on the exterior of the adjacent inner cores;

separating the adjacent inner cores to form first and second cross ties by separating the connecting member into a first part and a second part wherein the first part of the separated connecting member forms a portion of the first cross tie and the second part of the separated connecting member forms a portion of the second cross tie; and wherein the step of securing two adjacent inner cores together by attaching a connecting member to each of the adjacent inner cores includes forming an expansion gap between the connecting member and each of the adjacent inner cores; wherein the step of forming an outer casing on the exterior of the adjacent inner cores includes forming the outer casing on the inner core with the outer casing being at a higher temperature than the inner core; and wherein the method further includes allowing the outer casing material and inner core to reach a common temperature after forming the outer casing.

17. The method of claim 16 wherein the connecting member is provided with at least one first interlocking member on the first part of the connecting member and at least one first interlocking member on the second part of the connecting member;

wherein the step of providing a plurality of inner cores includes providing each of the longitudinally extending inner cores with at least one metallic reinforcing member and a metallic retention member disposed at an end of the inner cores wherein each of the retention members includes at least one second interlocking member; and wherein the step of securing the two adjacent inner cores together includes engaging the first interlocking member on the first par of the connecting member with the second interlocking member on the retention member on one of the inner cores and engaging the first interlocking member on the second part of the connecting member with the second interlocking member on the retention member on the other one of the inner cores.

18. The method of claim 16 further comprising the step of applying thermal energy to a seam formed between the connecting member and the outer casing on each of the first and second cross ties to thereby form a weld securing the connecting member with the outer casing.

19. The method of claim 16 wherein said step of securing two adjacent inner cores comprises securing the two adjacent inner cores with a unitary connecting member wherein the unitary connecting member imparts both compressive and tensile forces between the two adjacent inner cores when the two adjacent inner cores are secured together by the connecting member and wherein said step of separating the adjacent inner cores comprises cutting the connecting member.

20. A cross tie manufactured in accordance with the method of claim 16.

21. A method of manufacturing railroad cross ties, each of the cross ties having a longitudinal length, said method comprising:

providing a plurality of longitudinally extending inner cores for manufacturing a corresponding number of cross ties;

securing two adjacent inner cores together in an end-to-end configuration by attaching a connecting member to each of the adjacent inner cores;

forming an outer casing on the exterior of the adjacent inner cores;

separating the adjacent inner cores to form first and second cross ties by separating the connecting member into a first part and a second part wherein the first part of the separated connecting member forms a portion of the first cross tie and the second part of the separated connecting member forms a portion of the second cross tie; and applying thermal energy to a seam formed between the connecting member and the outer casing on each of the first and second cross ties to thereby form a weld securing the connecting member with the outer casing.

22. The method of claim 21 wherein the connecting member is provided with at least one first interlocking member on the first part of the connecting member and at least one first interlocking member on the second part of the connecting member;

wherein the step of providing a plurality of inner cores includes providing each of the longitudinally extending inner cores with at least one metallic reinforcing member and a metallic retention member disposed at an end of the inner cores wherein each of the retention members includes at least one second interlocking member; and wherein the step of securing the two adjacent inner cores together includes engaging the first interlocking member on the first par of the connecting member with the second interlocking member on the retention member on one of the inner cores and engaging the first interlocking member on the second part of the connecting member with the second interlocking member on the retention member on the other one of the inner cores.

23. The method of claim 21 wherein said step of securing two adjacent inner cores comprises securing the two adjacent inner cores with a unitary connecting member wherein the unitary connecting member imparts both compressive and tensile forces between the two adjacent inner cores when the two adjacent inner cores are secured together by the connecting member and wherein said step of separating the adjacent inner cores comprises cutting the connecting member.

24. A cross tie manufactured in accordance with the method of claim 21.

25. A method of manufacturing railroad cross ties, each of the cross ties having a longitudinal length, said method comprising:

providing a plurality of longitudinally extending inner cores for manufacturing a corresponding number of cross ties;

securing two adjacent inner cores together in an end-to-end configuration by attaching a connecting member to each of the adjacent inner cores;

forming an outer casing on the exterior of the adjacent inner cores;

separating the adjacent inner cores to form first and second cross ties by separating the connecting member into a first part and a second part wherein the first part of the separated connecting member forms a portion of the first cross tie and the second part of the separated connecting member forms a portion of the second cross tie; and wherein said step of securing two adjacent inner cores comprises securing the two adjacent inner cores with a unitary connecting member and said step of separating the adjacent inner cores comprises cutting the connecting member.

26. The method of claim 25 wherein the connecting member is provided with at least one first interlocking member on the first part of the connecting member and at least one first interlocking member on the second part of the connecting member;

wherein the step of providing a plurality of inner cores includes providing each of the longitudinally extending inner cores with at least one metallic reinforcing member and a metallic retention member disposed at an end of the inner cores wherein each of the retention members includes at least one second interlocking member; and wherein the step of securing the two adjacent inner cores together includes engaging the first interlocking member on the first par of the connecting member with the second interlocking member on the retention member on one of the inner cores and engaging the first interlocking member on the second part of the connecting member with the second interlocking member on the retention member on the other one of the inner cores.

27. A cross tie manufactured in accordance with the method of claim 25.

* * * * *